US008449639B2

(12) United States Patent
Sauer et al.

(10) Patent No.: US 8,449,639 B2
(45) Date of Patent: May 28, 2013

(54) VACUUM CLEANER FILTER BAG

(75) Inventors: Ralf Sauer, Overpelt (BE); Jan Schultink, Overpelt (BE)

(73) Assignee: Eurofilters Holding N.V., Overpelt (BE)

( * ) Notice: Subject to any disclaimer, the term of this patent is extended or adjusted under 35 U.S.C. 154(b) by 139 days.

(21) Appl. No.: 12/672,919

(22) PCT Filed: Jul. 14, 2008

(86) PCT No.: PCT/EP2008/005735

§ 371 (c)(1),
(2), (4) Date: May 3, 2011

(87) PCT Pub. No.: WO2009/024217

PCT Pub. Date: Feb. 26, 2009

(65) Prior Publication Data

US 2011/0203239 A1 Aug. 25, 2011

(30) Foreign Application Priority Data

Aug. 17, 2007 (EP) ..... 07016207

(51) Int. Cl.
*B01D 36/08* (2006.01)
*B01D 29/27* (2006.01)
*B01D 50/00* (2006.01)

(52) U.S. Cl.
USPC ..... 55/367; 55/368; 55/335; 55/361; 55/320; 55/374; 55/337; 55/381; 55/DIG. 2; 55/DIG. 3; 15/347; 15/353; 15/DIG. 8; 95/273

(58) Field of Classification Search
USPC ..... 55/367, 368, 335, 361, 320, 374, 55/337, 381, DIG. 3, DIG. 2; 15/347, 353, 15/DIG. 8; 95/273
See application file for complete search history.

(56) References Cited

U.S. PATENT DOCUMENTS

| | | | | |
|---|---|---|---|---|
| 4,257,791 | A * | 3/1981 | Wald | 55/382 |
| 4,917,942 | A * | 4/1990 | Winters | 96/99 |
| 4,948,266 | A * | 8/1990 | Bencic | 383/34 |
| 6,063,171 | A * | 5/2000 | Moyher et al. | 96/226 |
| 8,157,879 | B2 * | 4/2012 | Sauer et al. | 55/367 |
| 2007/0130894 | A1 * | 6/2007 | Schultink et al. | 55/381 |

(Continued)

FOREIGN PATENT DOCUMENTS

| | | |
|---|---|---|
| DE | 9 016 893 U1 | 4/1991 |
| DE | 201 01 471 U1 | 5/2001 |

(Continued)

OTHER PUBLICATIONS

International Search Report completed Sep. 23, 2008 for International Application No. PCT/EP2008/005735.

*Primary Examiner* — Duane Smith
*Assistant Examiner* — Minh-Chau Pham
(74) *Attorney, Agent, or Firm* — Brinks Hofer Gilson & Lione

(57) ABSTRACT

The invention relates to a vacuum cleaner filter bag, including an inlet opening (3), a filter bag material which has an inner layer of nonwoven material (10) at least in the region of the inlet opening, and a holding plate (2) which is arranged on the outside of the filter bag in the region of the inlet opening, can be attached to a vacuum cleaner holding means for securing the vacuum cleaner filter bag and on which a closure device (4) for closing the inlet opening is provided, wherein the nonwoven material, in the region of the inlet opening, has a surface (20) which is provided in such a manner that the formation of a filter cake on said surface is avoided.

18 Claims, 2 Drawing Sheets

U.S. PATENT DOCUMENTS

| | | | | |
|---|---|---|---|---|
| 2011/0047945 | A1* | 3/2011 | Schultink et al. | 55/368 |
| 2012/0131890 | A1* | 5/2012 | Schultink et al. | 55/368 |
| 2012/0186204 | A1* | 7/2012 | Schultink et al. | 55/368 |

FOREIGN PATENT DOCUMENTS

| | | | |
|---|---|---|---|
| DE | 102 03 460 | A1 | 8/2002 |
| DE | 202006019108 | U1 | 3/2007 |
| EP | 0 960 645 | A2 | 12/1999 |
| EP | 1 123 724 | B1 | 8/2001 |
| EP | 1 173 269 | B1 | 7/2003 |
| EP | 1 692 990 | A2 | 8/2006 |
| EP | 1 721 555 | A1 | 11/2006 |
| EP | 1 787 560 | A1 | 5/2007 |
| WO | WO 01/26526 | A1 | 4/2001 |
| WO | WO 03/073903 | A1 | 9/2003 |

* cited by examiner

VACUUM CLEANER FILTER BAG

This application claims the benefit under 35 U.S.C. §371 of International Application No. PCT/EP2008/005735, filed Jul. 14, 2008, which claims the benefit of European Patent Application No. 07016207.8, filed Aug. 17, 2007, which are incorporated herein by reference in their entirety.

FIELD OF THE INVENTION

The present invention refers to a vacuum cleaner filter bag comprising an inlet opening, a filter bag material which has an inner layer of nonwoven material at least in the region of the inlet opening, and a holding plate which is arranged on the outside of the filter bag in the region of the inlet opening, which can be attached to a vacuum cleaner holding means for mounting the vacuum cleaner filter bag, and on which a closing device, particularly a closing flap, for closing the inlet opening is provided.

BACKGROUND

Vacuum cleaner filter bags are arranged in the interior of the housing of a vacuum cleaner to collect the aspirated dust. To fasten the vacuum cleaner filter bag in the interior of the housing, vacuum cleaner filter bags comprise a corresponding holding plate via which the vacuum cleaner filter bag can be fixed on a holding device provided in the interior of the housing.

BRIEF SUMMARY

Such vacuum cleaner filter bags and holding plates comprise an inlet opening through which an air stream with dust particles can enter into the interior of the filter bag. It is desired for various reasons that this inlet opening can be closed. On the one hand, when a filled vacuum cleaner filter bag is disposed off, a closed inlet opening can prevent dust that has accumulated in the filter bag from exiting. Furthermore, some vacuum cleaner filter bags comprise loose particles, e.g. for odor absorption. To prevent such particles from falling out of the bag, it is also of advantage when the inlet opening is closed.

In recent years nonwoven fabrics have became widely accepted as vacuum-cleaner filter bag materials that are distinguished by their low tendency to clogging and their high dust-retaining capacity.

The drawback of these known vacuum cleaner filter bags is that house dust, which also contains fiber-like constituents, such as carpet fibers or hair, also deposits in the region of the inlet opening as a relatively solid filter cake, where it may impair the closing function of the holding plate.

To be more specific, the filter cake often projects into the pivot region of the closing flap, so that, while the flap is being closed, a varying amount of material gets pinched, thereby preventing the closing function, i.e. the closing flap does not completely close the vacuum cleaner filter bag.

The formation of the filter cake in a particularly great amount can be observed in regions with hardly any flow, e.g. in the region of the hinge of the closing flap.

In the light of this prior art, it is the object of the present invention to provide a vacuum cleaner filter bag which is distinguished by an improved closing function.

According to the invention a vacuum cleaner filter bag is provided, comprising an inlet opening, a filter bag material which has an inner layer of nonwoven material at least in the region of the inlet opening, and a holding plate which is arranged on the outside of the filter bag in the region of the inlet opening, which can be attached to a vacuum cleaner holding means for mounting the vacuum cleaner filter bag, and on which a closing device for closing the inlet opening is provided, wherein the nonwoven material, in the region of the inlet opening, has an area which is provided in such a manner that the formation of a filter cake on said area is avoided.

The provision of an area of the nonwoven material on which no filter cake can form, i.e., unoccupied area, hereinafter also called free area, offers the advantage that not many fibers will deposit near the inlet opening, whereby the formation of a filter cake in said region is avoided. Hence, dust is not in a position to grip into the surface (form fit) and thereby to form start points for the buildup of a filter cake. As a result, the closing device is not hindered in any way by a filter cake projecting into the region of the closing device.

In the vacuum cleaner filter bag according to the invention, the area (free area) can be formed completely or in part by a foil, particularly a self-adhesively coated foil. This is a particularly efficient way for preventing the buildup of a filter cake. The foil can e.g. be fastened by gluing (coated foil) or welding.

In the vacuum cleaner filter bag according to the invention the area (free area) is formed completely or in part by paper, cardboard or paperboard, particularly self-adhesively coated paper, self-adhesively coated cardboard, or self-adhesively coated paperboard. The use of smooth paper, cardboard or paperboard for covering part of the nonwoven material that is directly adjacent to the inlet opening presents an alternative to the foil.

In the vacuum cleaner filter bag according to the invention the area (free area) is formed completely or in part by compacted nonwoven material. This can give the surface of the nonwoven material a foil-like character. Such compaction can be accomplished by ultrasonic or thermal welding. This provides another alternative.

In the vacuum cleaner filter bag according to the invention the area (free area) can be formed completely or in part by a liquid which is drying while forming a film. The nonwoven material is thereby made smooth on the area (free area). This presents a further alternative.

If an adequate effect is not achieved with one of the aforementioned alternatives alone, the alternatives may also be combined. For instance it is possible in an advantageous way to first compact the corresponding region of the free area thermally and then to provide it with a foil in addition.

In the vacuum cleaner filter bag according to the invention the area (free area) can be configured in the form of a strip, preferably of a ring, extending around the inlet opening. This has the advantage that a region extending around the inlet opening is kept free of filter cake. The surrounding strip may be open or closed, so that in the last-mentioned case the inlet opening is fully surrounded by the strip (ring).

The said strip or ring may be of a varying width in a portion. It can thereby be adapted to the respective conditions in an optimum way.

For instance, it makes sense to make the strip broader near a closing flap hinge and to keep it smaller in regions where high flow velocities are prevailing. Since filtrate is preferably deposited near the inlet opening where the velocity of the flow is small, it is of advantage to make the strip broader at this place. This is also done for achieving the most efficient use for the filter bag area in the way that the strip is made only so broad as is necessary to prevent any blocking of the closure because there is no or only a very insignificant filtering action in the free area.

As an alternative, the strip may also be shaped in the form of a ring, which offers a simple possibility of producing the vacuum cleaner filter bag according to the invention.

The strip in both of the aforementioned alternatives may have a width ranging from 5 mm to 150 mm, preferably from 10 mm to 50 mm. The minimum width follows from the typical expansion of a filter cake of house dust beyond an edge. The maximum width is only restricted insofar as the loss in efficient filter area should be kept as small as possible. A relatively large width may be necessary whenever the filling opening is seated near an edge of the filter bag and the filter cake is growing from the side area into the pivot region of the flap.

In the vacuum cleaner filter bag according to the invention the closing device may comprise a pivotable closing element, whereby an efficient closing mechanism is provided. The closing element may here be arranged in the interior of the filter bag in the region of the inlet opening.

In the vacuum cleaner filter bag according to the invention the aforementioned foil may further be useable as a sealing element between filter bag and holding means of the vacuum cleaner, wherein the foil can particularly be made from a thermoplastic elastomer. Hence, the foil can additionally be used as a sealing element towards the nozzle (sole or additional seal between vacuum cleaner and filter bag).

In the vacuum cleaner filter bag according to the invention the compacted nonwoven material can also be used as a sealing element between filter bag and holding means of the vacuum cleaner. In the two last-mentioned developments a separate seal is thus not needed.

In the vacuum cleaner filter bag according to the invention the said foil may be made antistatic, which additionally prevents fibers and dust from depositing on the area (free area).

BRIEF DESCRIPTION OF THE DRAWINGS

Further advantages and features of the invention shall be explained hereinafter by way of example with reference to the figures, in which.

DETAILED DESCRIPTION

Figure 1:
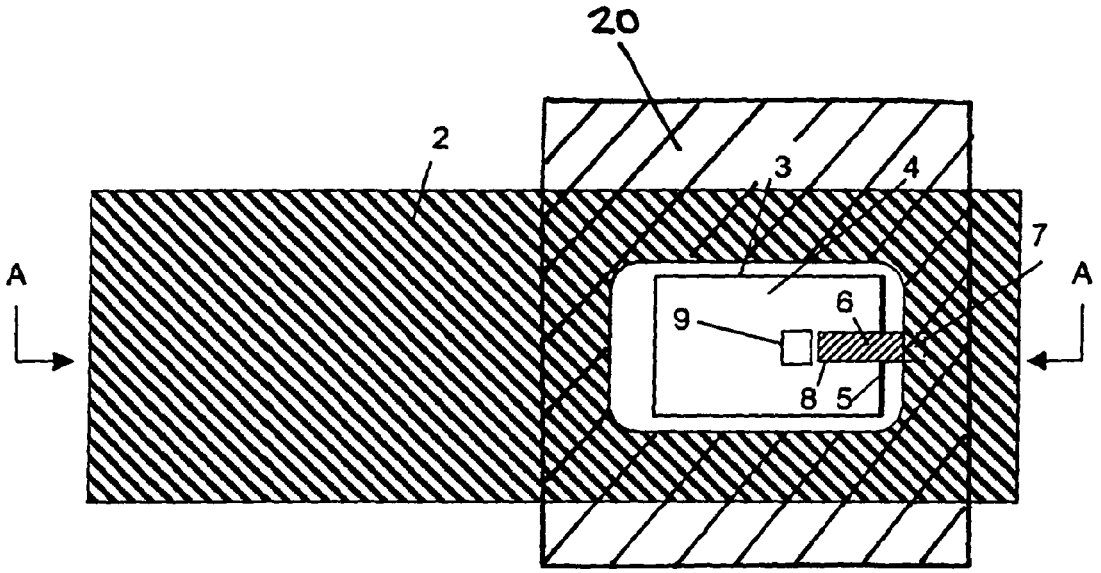
FIG. 1 is a top view on a holding plate of the vacuum cleaner filter bag according to the invention with closed inlet opening.

FIG. 1 shows a schematic top view (in a direction opposite to the opening direction) on a holding plate 2 of a vacuum cleaner filter bag according to the invention. Said holding plate 2 is e.g. provided in the form of an injection-molded part made from a plastic material. The holding plate 2 has provided therein an inlet opening 3, which in the illustrated example is closed by a closing element or a closing flap 4. Closing element 4 and holding plate 2 are made integral as an injection-molded part, with the closing element 4 being connected to the holding plate 2 via a film hinge 4, by which a pivot axis is formed.

Furthermore, a spring element 6 is provided in the form of a leaf spring to hold the closing element 4 in the illustrated first position, the closing position. One longitudinal end 7 of the leaf spring 6 is firmly connected to the holding plate 2 by being embedded in the plastic material. The other longitudinal end 8 is movably positioned on the closing element 4. The leaf spring 6 is arranged in opening direction behind the closing element 4, whereas it is positioned in the illustrated top view in a direction opposite the opening direction in front of the closing element 4.

Furthermore, the closing element 4 has formed therein a hole 9 into which the leaf spring 6 will engage upon pivoting of the closing element 4 in opening direction. The leaf spring 6 is cambered, i.e., it shows a continuous curvature in a direction transverse to the longitudinal axis. Due to this curvature the leaf spring 6 contacts the surface of the closing element 4 only on its longitudinally extending side edges.

The nonwoven material, which is not shown in this figure for the sake of clarity, is provided around the inlet opening 3 with an area 20 provided with a self-adhesive foil, which prevents the buildup of a filter cake on said area.

Figure 2:
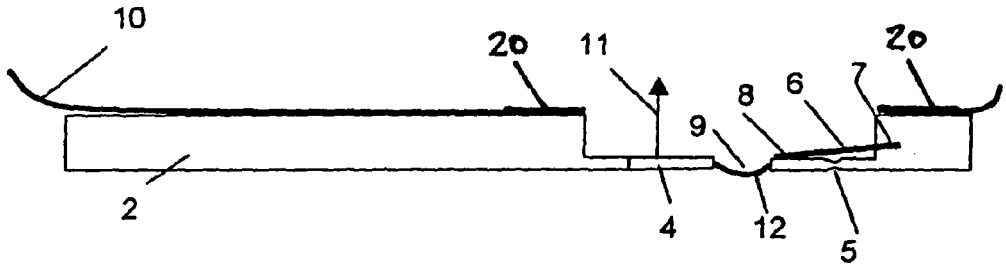
FIG. 2 is a cross-sectional view of the holding plate of FIG. 1.
Figure 3:
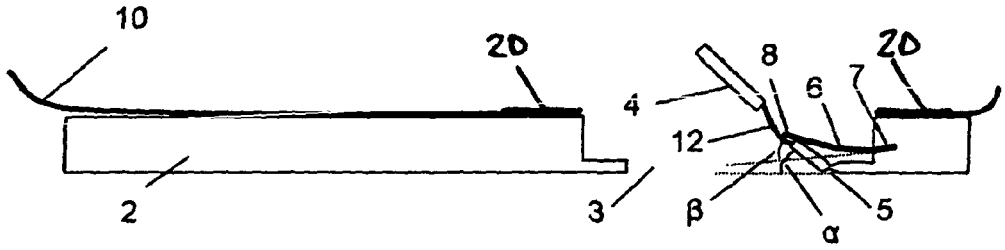
FIG. 3 is a cross-sectional view of a holding plate with opened inlet opening.

FIG. 2 is a schematic cross-sectional view through the holding plate of FIG. 1 along line A-A, which extends along one of the longitudinal axes of the leaf spring 6. As can be seen from this cross-sectional view, the one longitudinal end 7 of the leaf spring 6 is embedded in the plastic material of the holding plate 2 and thus fixed. The other longitudinal end 8 contacts the closing element 4 in the area of the side edges of the leaf spring (the contact area), so that with an appropriately selected bias of the leaf spring the closing element is held by the restoring force of the spring in the illustrated first position or closing position.

The holding plate 2 is connected to the nonwoven material 10 of a vacuum cleaner filter bag, for instance by gluing. As an alternative, the bag wall may also comprise fastening elements fixedly connected thereto, which elements may then have connected thereto a holding plate in a detachable way without destruction, so that such a holding plate can be used repeatedly. The bag wall may have a filter structure, as is e.g. described in EP 0 960 645.

The nonwoven material 10 is provided around the inlet opening with the area 20 equipped with a self-adhesive foil, which area is also shown in FIG. 1.

In the illustrated example the hole 9 is a blind hole the bottom 12 of which is formed by an elastic foil. Such an elastic cover of the hole 9 can be accomplished in that a TPE (thermoplastic polymer) is injected in the two-component method onto this region of the closing element. Such a bottom prevents a situation where dirt exits through the hole out of the interior of the bag.

During operation of the vacuum cleaner filter bag in a vacuum cleaner housing the closing element 4 is acted upon by a vacuum stream with a force working against the restoring force of the leaf spring 6. When the force of the vacuum stream exceeds the restoring force of the leaf spring, the closing element will be pivoted in opening direction 11, see FIG. 2, and thus in the direction of the interior of the filter bag about the pivot axis formed by the film hinge 5.

Due to this pivotal movement the contact area of the closing element 4 moves along the side edges of the leaf spring 6 in the direction of the clamped longitudinal end 7. This has the effect that the other longitudinal end 8 engages into the hole 9 provided in the closing element. Due to this engagement the bending angle $\beta$ of the leaf spring 6 is smaller than the opening angle $\alpha$ of the closing element. The bending force needed for pivoting the closing element 4 is thereby kept small so that the inlet opening 3 can also be opened in a safe way in the case of a weak vacuum stream.

With an appropriately deep penetration of the leaf spring 6 into the hole 9 the spring reaches the bottom 12 in the form of a foil which will be deformed upon further pivoting in opening direction. Thus the spring characteristic can additionally be modified by the elastic bottom.

As an alternative to the illustrated example the blind hole may also be formed by a hollow in the closing element, so that the bottom in the case of a stiff plastic material is made non-elastic. Instead of this, the hole 9 may also be a through hole. The latter is especially of advantage in a configuration with a hole in the holding plate and not in the closing element because in this case the connection of the holding plate with the filter material of the bag wall can be chosen such that the hole does not terminate in the interior of the bag (i.e. it terminates outside the bag wall) and dirt can thus not exit through said hole out of the bag.

Figure 4:
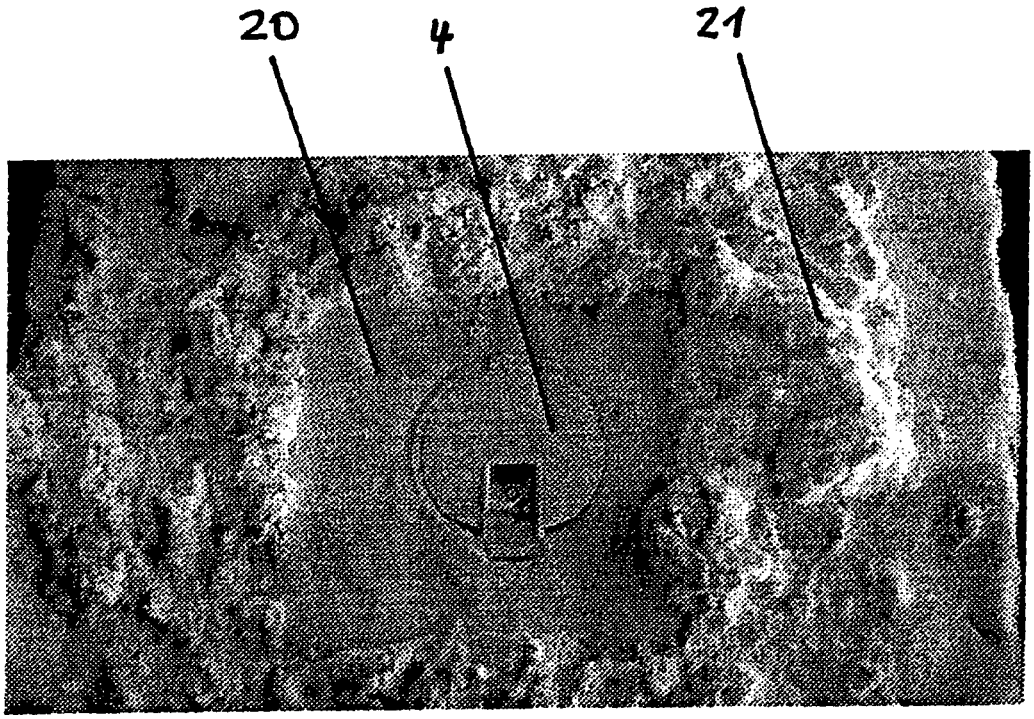
FIG. 4 is a photographic top view on a vacuum cleaner filter bag according to the invention with filter cake.

FIG. 4 is a photo showing a used filter bag according to the invention. The direct neighborhood 20 of the inlet opening, which is closed by the closing element 4, is free of filter cake 21. In this example, the area 20 is implemented by a foil which due to its smoothness and tightness substantially prevents the filtrate from depositing.

It goes without saying that the above-described embodiments shall be understood by way of example and the illustrated and described features can also be combined with one another in a different way.

The invention claimed is:

1. A vacuum cleaner filter bag comprising an inlet opening, a filter bag material comprising an inner layer of nonwoven material at least in the region of the inlet opening, the nonwoven material, in the region of the inlet opening comprising an area positioned to avoid the formation of a filter cake on the area, and a holding plate arranged on an exterior portion of the filter bag in the region of the inlet opening, the holding plate configured for attachment to a vacuum cleaner holding means for mounting the vacuum cleaner filter bag, and on the holding plate a closing device for closing the inlet opening is provided;

wherein the area is provided so that the closing device is not hindered by formation of the filter cake on the area and the closing device closes the inlet opening.

2. The vacuum cleaner filter bag according to claim 1, wherein the area is formed completely or in part by a foil.

3. The vacuum cleaner filter bag according to claim 1, wherein the area is formed completely or in part by paper, cardboard or paperboard, particularly self-adhesively coated paper, self-adhesively coated cardboard, or self-adhesively coated paperboard.

4. The vacuum cleaner filter bag according to claim 1, wherein the area is formed completely or in part by compacted nonwoven material.

5. The vacuum cleaner filter bag according to claim 1, wherein the area is formed completely or in part by a liquid, the liquid forming a film while drying.

6. The vacuum cleaner filter bag according to claim 1, wherein the area comprises a strip extending around the inlet opening.

7. The vacuum cleaner filter bag according to claim 6, wherein the strip has a varying width.

8. The vacuum cleaner filter bag according to claim 6, wherein the strip is ring-shaped.

9. The vacuum cleaner filter bag according to claim 7, wherein the strip has a width ranging from 5 mm to 150 mm.

10. The vacuum cleaner filter bag according to claim 1, wherein the closing device comprises a pivotable closing element.

11. The vacuum cleaner filter bag according to claim 10, wherein the closing element is arranged in the interior of the filter bag in the region of the inlet opening.

12. The vacuum cleaner filter bag according to claim 2, wherein the foil comprises a sealing element between filter bag and holding means of the vacuum cleaner.

13. The vacuum cleaner filter bag according to claim 12, wherein the foil is made from a thermoplastic elastomer.

14. The vacuum cleaner filter bag according to claim 4, wherein the compacted nonwoven material comprises a sealing element between filter bag and holding means of the vacuum cleaner.

15. The vacuum cleaner filter bag according to claim 2, wherein the foil is made antistatic.

16. The vacuum cleaner filter bag according to claim 2, wherein the foil comprises a self-adhesively coated foil.

17. The vacuum cleaner filter bag according to claim 1, wherein the area comprises self-adhesively coated paper, self-adhesively coated cardboard, or self-adhesively coated paperboard.

18. The vacuum cleaner filter bag according to claim 7 wherein the strip has a width ranging from 10 mm to 50 mm.

* * * * *

UNITED STATES PATENT AND TRADEMARK OFFICE

CERTIFICATE OF CORRECTION

PATENT NO. : 8,449,639 B2
APPLICATION NO. : 12/672919
DATED : May 28, 2013
INVENTOR(S) : Sauer et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 582 days.

Signed and Sealed this
Eighth Day of September, 2015

Michelle K. Lee

Michelle K. Lee
*Director of the United States Patent and Trademark Office*